US005564389A

United States Patent [19]

Mueller et al.

[11] Patent Number: 5,564,389

[45] Date of Patent: Oct. 15, 1996

[54] FORCE MOTOR FOR USE IN THE FUEL SYSTEM OF AN INTERNAL COMBUSTION ENGINE

[75] Inventors: James Mueller, Rockford, Ill.; Nicholas F. Campagna, Menomonee Falls, Wis.

[73] Assignee: Barber-Colman Corporation, Loves Park, Ill.

[21] Appl. No.: 499,964

[22] Filed: Jul. 10, 1995

[51] Int. Cl.[6] ..... F02D 31/00

[52] U.S. Cl. ..... 123/357

[58] Field of Search ..... 123/357, 361, 123/373, 449, 399–400

[56] References Cited

U.S. PATENT DOCUMENTS

| | | | |
|---|---|---|---|
| 3,735,302 | 5/1973 | Eckert . | |
| 3,883,839 | 5/1975 | Barrett et al. . | |
| 4,572,131 | 2/1986 | Hashimoto et al. | 123/357 |
| 4,616,616 | 10/1986 | Staniak et al. | 123/357 |
| 4,854,282 | 8/1989 | Knorreck | 123/357 |
| 4,855,702 | 8/1989 | Swanson et al. . | |
| 4,922,873 | 5/1990 | Gaeti | 123/357 |
| 5,293,093 | 3/1994 | Warner . | |
| 5,362,209 | 11/1994 | Day | 123/357 |

*Primary Examiner*—Thomas N. Moulis
*Attorney, Agent, or Firm*—Rockey, Rifkin and Ryther

[57] ABSTRACT

A force motor includes an electromagnetic rotary actuator and a governor cup for use in the fuel system of an internal combustion engine to permit a desired fuel flow to pass to the engine. The rotary actuator includes a cylindrical housing over which two coils are wound. The magnetic field generated by applying direct current to the coils interacts with a permanent magnet rotor field to rotate an output shaft against the biasing force of a return spring. A governor cup includes a magnet permitting magnetic engagement of the fuel rod to the governor cup. The rotation of the output shaft is translated into linear movement of the fuel rod by a linkage. The rotary actuator has constant output torque characteristics for a given current level to permit the fuel rod to be correctly positioned for the desired fuel flow.

7 Claims, 5 Drawing Sheets

FORCE MOTOR FOR USE IN THE FUEL SYSTEM OF AN INTERNAL COMBUSTION ENGINE

BACKGROUND OF THE INVENTION

The present invention generally relates to fuel systems in internal combustion engines and, more particularly, to a force motor including an electromagnetic rotary actuator having constant output torque characteristics and a governor cup, both permitting the correct positioning of the fuel rod in the fuel system of an internal combustion engine.

Electromagnetic actuators and other types of positioners are well known in the art. For example, in U.S. Pat. No. 3,735,302, an armature moves on a guide loft against the force of a return spring and in U.S. Pat. No. 3,883,839, an armature or actuator moves on a hollowed shaft containing bearings and a return spring. In U.S. Pat. No. 4,855,702, a shaft extends through a central opening in a frusto-conical projection and carries an armature having a reciprocally configured frusto-conical surface. Excitation of a winding which surrounds the frusto-conical projection moves the shaft linearly on bearings contained in the housing against the force of a return spring.

These types of electromagnetic actuators are suitable for typical positioning applications and can be used in internal combustion engines. However, it is desirable to provide an electromagnetic rotary actuator comprised of inexpensive materials which can be manufactured with low labor costs to permit the fuel rod of an internal combustion engine to be correctly positioned as required. It is also desirable to blindly connect the fuel rod to the rotary actuator without the use of fasteners to extend the useful life of the fuel control system and to allow an engine to be easily maintained.

SUMMARY OF THE INVENTION

The present invention comprises a force motor including an electromagnetic rotary actuator and a permanent magnet governor cup for use in the fuel system of an internal combustion engine. The rotary actuator includes a cylindrical housing over which a coil is wound. When current is applied to the coil, a permanent magnet rotor rotates inside the cylinder against the biasing force of a return spring which biases the rotor in an initial position. An output shaft is attached to the rotor and a governor cup is attached to the output shaft via a linkage for translating the rotation of the rotor into linear movement of the fuel rod. The governor cup also includes a permanent magnet permitting blind attachment of the fuel rod without the use of fasteners. The rotary actuator has constant output torque characteristics for given input current levels.

DESCRIPTION OF THE INVENTION

Figure 1:
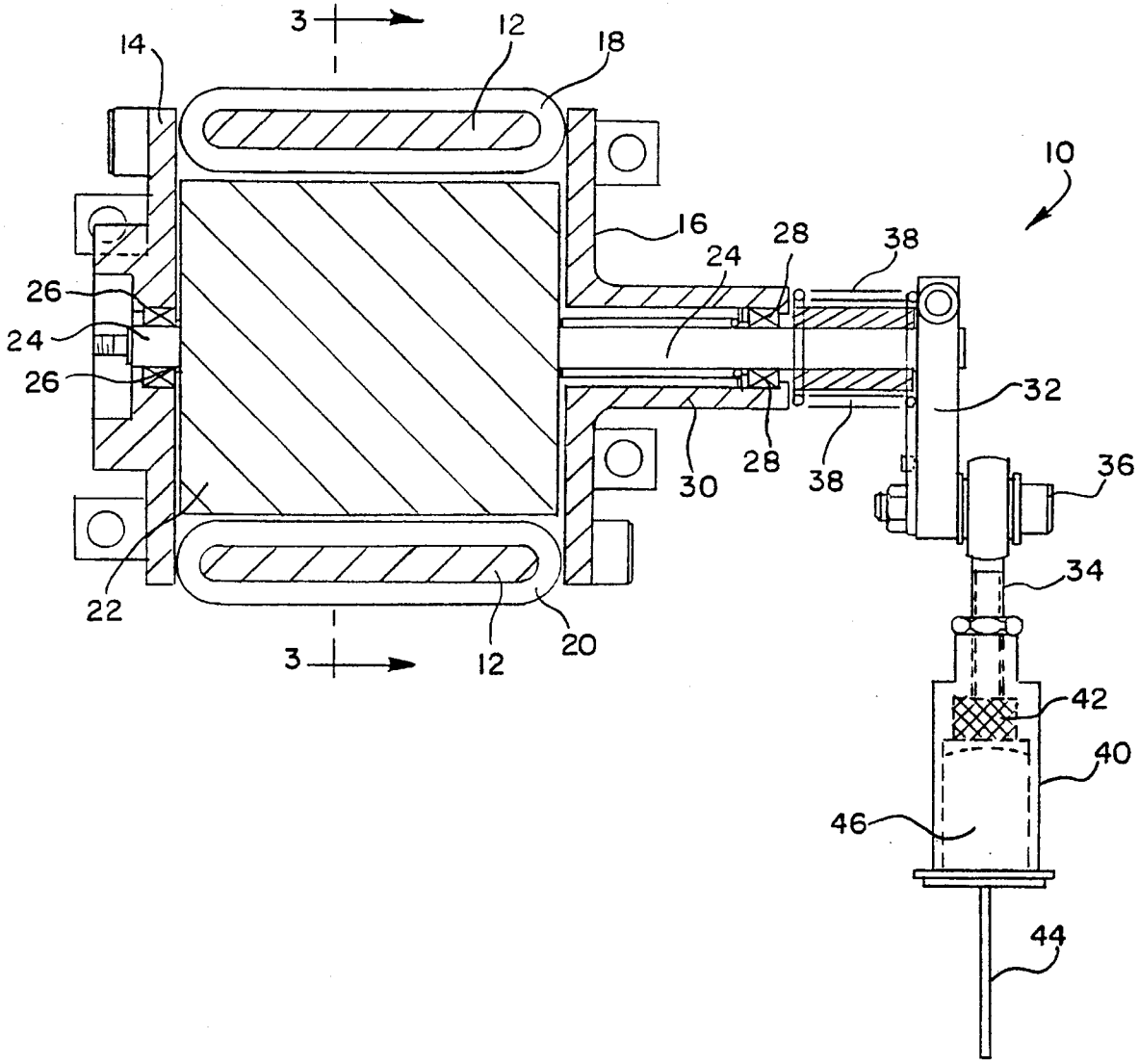
FIG. 1 is a side partial cross-sectional view of the force motor of the present invention.
Figure 2:
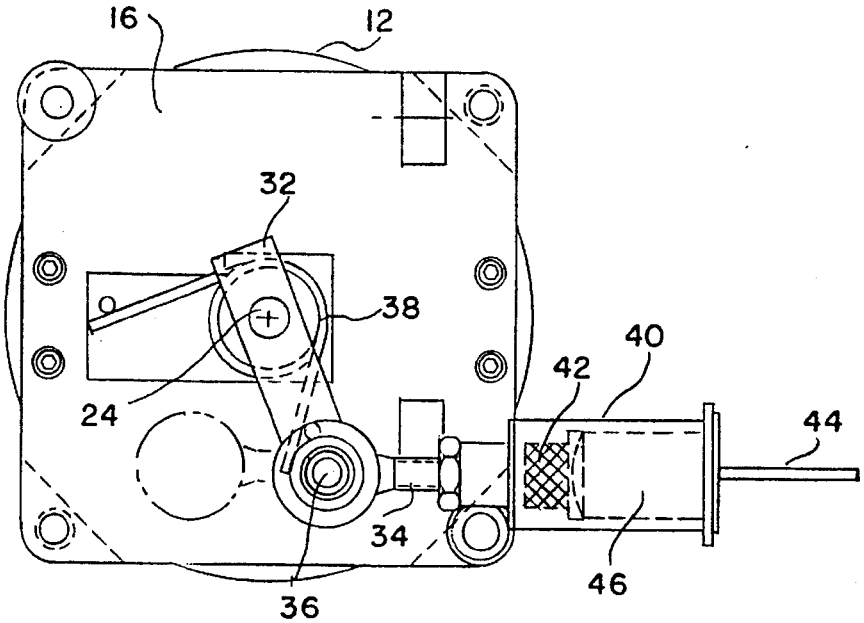
FIG. 2 is an end view of the force motor shown in FIG. 1.
Figure 3:
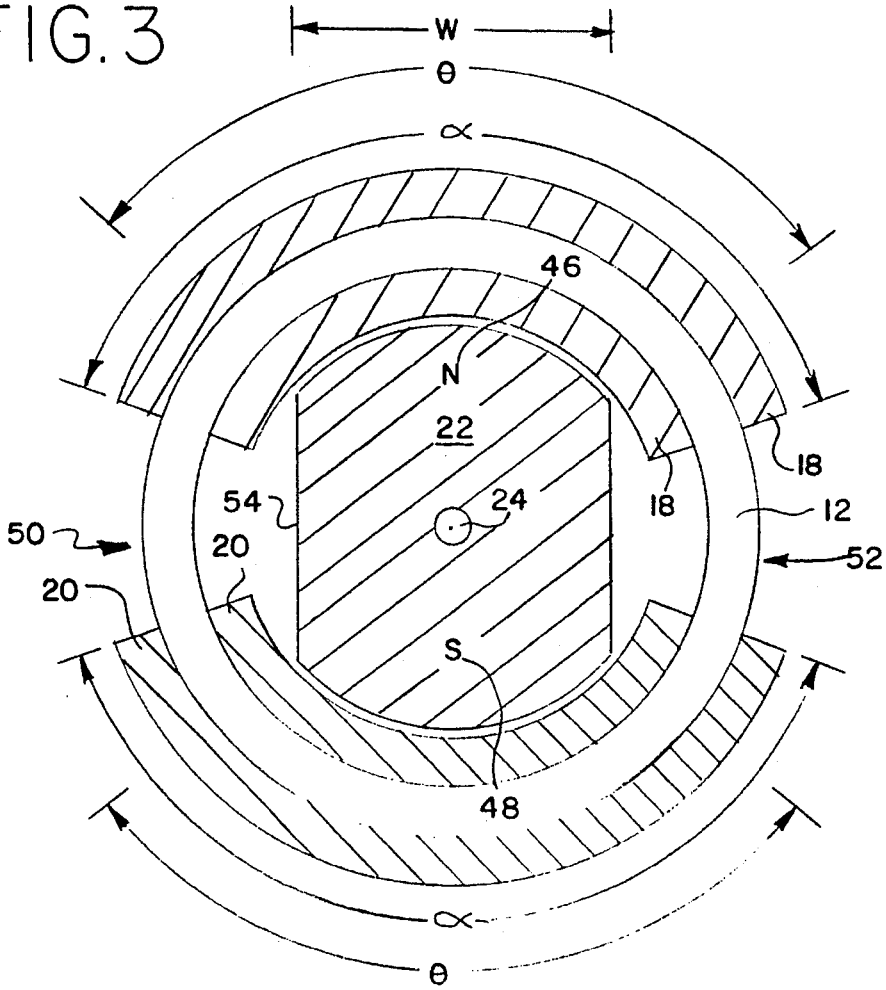
FIG. 3 is a cross-sectional view of the rotor assembly taken along lines 3—3 in FIG. 1.

Referring to FIGS. 1–3, a force motor 10 includes a cylindrical housing 12 which is enclosed by end caps 14 and 16 and two separate coils 18 and 20 wound over a portion of cylindrical housing 12. A permanent magnet rotor 22 is axially mounted on output shaft 24 and co-rotates therewith on bearings 26 and 28 supported in end caps 14 and 16, respectively. End cap 16 includes an extended front portion 30 from which output shaft 24 extends. Output shaft 24 is connected to a link 32 by means of a suitable fastener such that link 32 rotates about the axis of output shaft 24.

Referring to FIG. 2, link 32 is attached to link 34 via pin 36. Link 32 is biased to an initial, at-rest position shown in solid in FIG. 1 by spring 38. Link 32 can be moved to a plurality of positions, one of which is shown in phantom in FIG. 1, by the rotation of output shaft 24 as discussed hereafter. A governor cup 40 is attached to link 34 and includes a permanent magnet 42 positioned in its hollow interior. The fuel rod 44 of an internal combustion engine includes an enlarged head 46 which is inserted into the hollow interior of governor cup 40. Head 46 is attracted to magnet 42 thereby to blindly attach fuel rod 44 to governor cup 40 without the use of fasteners permitting ease of engine maintenance.

Referring to FIG. 3, permanent magnet rotor 22 includes north and south poles 46 and 48, respectively. Coils 18 and 20 are symmetrically wound and centered around housing 12 and occupy (alpha) degrees of its angular extent. Gaps 50 and 52 are provided between each coil to permit end caps 14 and 16 (FIG. 1) to support cylindrical housing 12 and coils 18 and 20. Alternatively, coils 18 and 20 can be positioned in the interior of housing 12. In the FIG. 3 embodiment, each coil occupies 140 degrees of the angular extent of housing 12.

When direct current is applied to coils 18 and 20 via a terminal means (not shown), a constant magnetic field is generated which rotates rotor 22 in a counterclockwise direction as viewed in FIG. 3. The magnetic flux generated by applying current to coils 18 and 20 is additive and cooperates to rotate rotor 22 counterclockwise with the flux path being completed through housing 12 irrespective of the position of rotor 22.

Figure 3A:
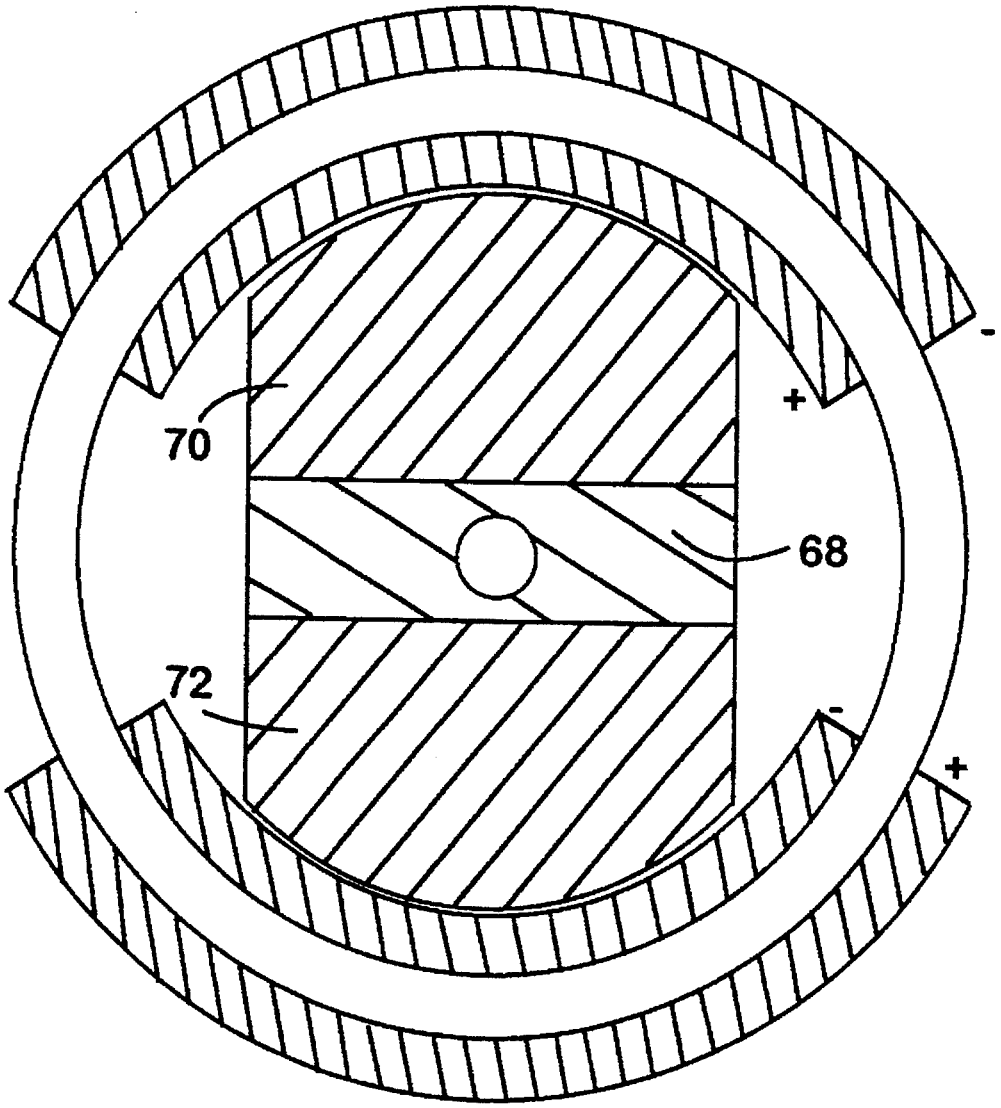
FIGS. 3A and 3B illustrate alternate rotor constructions.
Figure 3B:
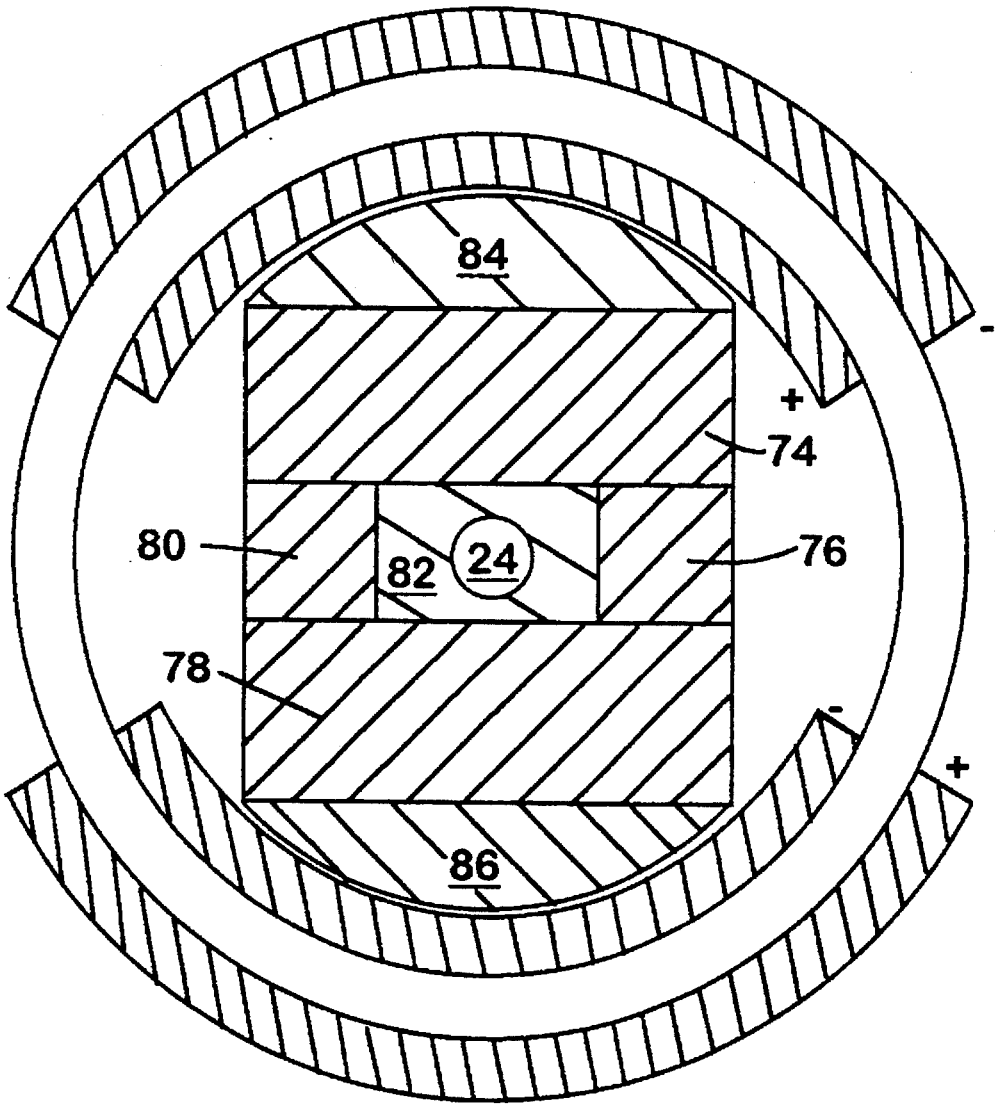

In a preferred embodiment, rotor 22 is manufactured from a magnetic ceramic material having a permanent magnetic flux and is semi-cylindrical as illustrated in FIG. 2. FIGS. 3A and 3B show alternate constructions of rotor 22 suitable for use with the present invention. In FIG. 3A, an iron centerpiece 68 is sandwiched between two pieces of permanent magnet material 70 and 72. In FIG. 3B, four blocks of permanent magnet material 74–80 surround a center iron block 82 which supports rotor shaft 24. To complete the rotor, two semicircular pieces of iron 84 and 86 are attached to the extremities of blocks 74 and 78, respectively. Alternatively, the semi-cylindrical shaped rotor can comprise a plastic binder in which magnetic materials are embedded. In all of the illustrated embodiments, the permanent magnetic material is selected from the following group: ceramic ferrite, Alnico, or rare earth material such as summarium cobalt or neodymium iron boron.

In the embodiment of FIG. 3, rotor 22 can rotate through an angular extent of forty degrees while providing constant output torque for a given input current to coils 18 and 20. To permit rotor 22 to be rotated through a larger angle, sides 54 and 56 of rotor 22 can be shaved to "thin out" rotor 22 and correspondingly decrease the spatial extent of its permanent magnetic flux. Also, coils 18 and 20 can occupy more of the angular extent of cylinder 12 and include more turns to permit greater torque to be generated for given current levels. For applications of the force motor requiring higher permanent magnetic flux levels, more expensive magnetic material can be used for rotor 22 and larger currents can be applied to coils 18 and 20. Either approach will produce higher torque, individually or collectively.

In general, force motor 10 is used to correctly position fuel rod 44 as required to control the flow rate of fuel permitted to pass into an internal combustion engine. Precise position control of fuel rod 44 is necessary to ensure that the correct fuel flow passes to the engine. To accomplish this, a given amperage of direct current is applied to each coil 18 and 20 to rotate rotor 22, shaft 24 and link 32 counterclockwise as viewed in FIG. 3 against the biasing force of spring 38. As link 32 rotates, the governor cup 40 and fuel rod 44 are linearly moved to the correct position as required by the amperage of input current as discussed hereafter.

Figure 4:
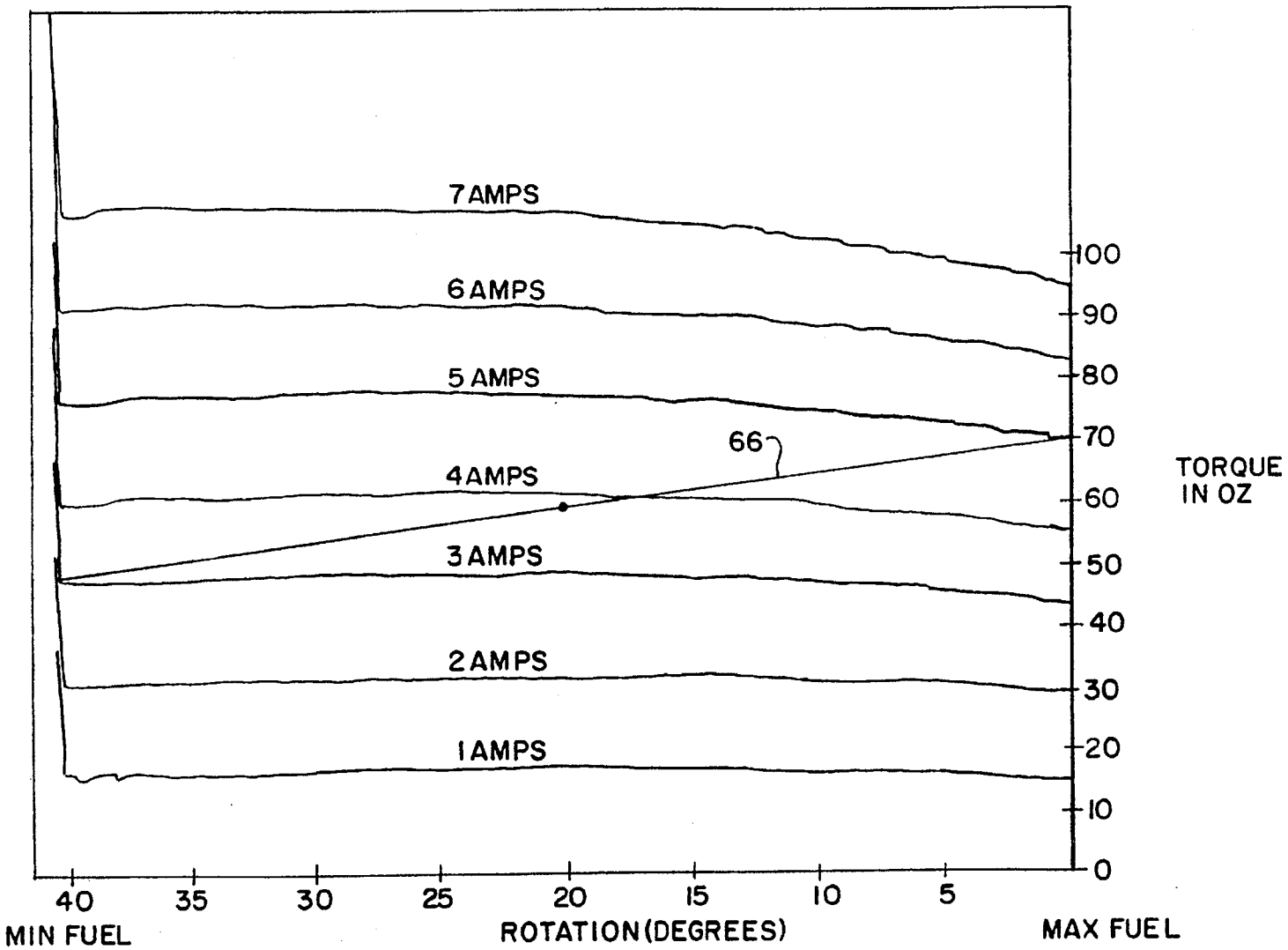
FIG. 4 is a graph illustrating the flat output torque characteristic provided by the force motor of FIG. 1.

FIG. 4 is a graph illustrating the flat output torque characteristics of the force motor 10 according to the present invention. At constant current levels, the torque applied to shaft 24 by the rotation of rotor 22 in the magnetic field which is generated by the application of current to the coils is constant from zero to approximately forty degrees of rotation of output shaft 24. As the current applied to coils 18 and 20 increases, the torque applied to shaft 24 correspondingly increases due to the action of the increased magnetic field strength on the permanent magnetic rotor 22.

Torsional spring 38 is provided to generate a torque that opposes the torque provided by the rotation of rotor 22 in the magnetic field generated when current is applied to coils 18 and 20. In particular, the rotation of output shaft 24 and link 32 torsions spring 38 generating an increasing amount of torque as the rotation increases. When these forces cancel out, the fuel rod is positioned correctly to permit a desired fuel flow to the engine.

In the embodiment illustrated in FIGS. 1–3, a ceramic ferrite material is used for rotor 22 and coils 18 and 20 occupy approximately 140 degrees of the angular extent of cylindrical housing 12. Referring to FIG. 4, trace 66 illustrates that the torque generated by the torsion of spring 38 is approximately linearly related to the degrees of rotation of shaft 24 and link 32. When link 32 is disposed in its initial position shown in solid in FIG. 2, the fuel rod 44 is positioned to prevent any fuel from flowing to the engine which is noted as 40 degrees rotation on the x-axis of FIG. 4.

When link 32 is rotated 40 degrees from this position as noted by 0 degrees on the x-axis of FIG. 4, fuel rod 44 is positioned to provide a maximum fuel flow to the engine. For example, 4 amps of current must be applied to coils 18 and 20 to rotate shaft 24 approximately twenty-three degrees from its initial position and to generate 60 in-oz of torque which is canceled by the 60 in-oz of torque generated by spring 38.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A force motor for use on an internal combustion engine to control the position of a fuel rod to permit a desired fuel flow comprising:

a) an electromagnetic rotary actuator having a centrally disposed output shaft the rotational position of which is determined as a substantially linear function of the current applied to said actuator;

b) means for biasing said output shaft to an initial position when no current is applied to said actuator;

c) a governor cup for engaging the fuel rod; and d) linkage means for securing said governor cup to said output shaft to translate the rotation of said output shaft to linear movement of said fuel rod, whereby the current level applied to said rotary actuator controls the position of said fuel rod.

2. The force motor of claim 1 wherein said electromagnetic rotary actuator includes:

a) a cylindrical housing;

b) coil means wound around said housing for generating a magnetic field when current is applied thereto; and c) a permanent magnet rotor coaxially secured to said output shaft, the rotational position of said rotor being determined by the amount of direct current applied to said coil means due to magnetic deflection of said rotor from said initial position.

3. The force motor of claim 1 wherein said governor cup includes a permanent magnet permitting magnetic engagement of said fuel rod.

4. The force motor of claim 2 wherein said coil means comprises first and second coils wrapped over selected portions of said cylindrical housing in spaced relation to permit the magnetic fields generated by applying current thereto to be additive.

5. The force motor of claim 2 wherein the material comprising said permanent magnetic rotor is chosen from the following group: ceramic ferrite, Alnico, summarium cobalt or neodymium iron boron.

6. The force motor of claim 1 wherein said means for biasing comprises a return spring.

7. The force motor of claim 3 wherein said governor cup includes a cylindrical housing open at one end and having a hollow interior to permit engagement of said fuel rod by said permanent magnet whereby said fuel rod can be disengaged from said governor cup by manually overcoming the force of said permanent magnet.

* * * * *